United States Patent [19]

Fukui et al.

[11] Patent Number: 4,626,120

[45] Date of Patent: Dec. 2, 1986

[54] RESILIENT WRITING NIB WITH OFFSET FLATTENED PORTION

[75] Inventors: Hishao Fukui, Tokyo; Yutaka Shinohara, Konosu; Takashi Tamura, Yashio, all of Japan

[73] Assignee: Pentel Kabushiki Kaisha, Nihonbashi, Japan

[21] Appl. No.: 653,785

[22] Filed: Sep. 24, 1984

[30] Foreign Application Priority Data

Sep. 30, 1983 [JP] Japan ..... 58-152554[U]
Sep. 30, 1983 [JP] Japan ..... 58-152555[U]

[51] Int. Cl.[4] ..... B43K 1/10; B43K 1/06; B43K 8/00

[52] U.S. Cl. ..... 401/260; 401/199; 401/264

[58] Field of Search ..... 401/260, 264, 206, 199, 401/259

[56] References Cited

U.S. PATENT DOCUMENTS

| | | | |
|---|---|---|---|
| 226,925 | 4/1880 | Nimmo | 401/260 |
| 376,760 | 1/1888 | Stewart | 401/260 |
| 618,845 | 2/1899 | Crosby | 401/264 |
| 776,951 | 12/1904 | Sinnott | 401/260 X |
| 1,373,566 | 4/1921 | Neukirchen | 401/264 X |
| 1,378,016 | 5/1921 | Erwin | 401/264 |
| 1,438,510 | 12/1922 | Wasserlein | 401/260 |
| 1,595,260 | 8/1926 | Swope | 401/260 X |
| 2,080,778 | 5/1937 | Lemoine et al. | 401/206 |
| 4,364,684 | 12/1982 | Kohno et al. . | |
| 4,410,290 | 10/1983 | Ito et al. | 401/199 X |

FOREIGN PATENT DOCUMENTS

| | | | |
|---|---|---|---|
| 85902 | 10/1921 | Austria | 401/260 |
| 56-3684 | 1/1981 | Japan . | |

*Primary Examiner*—Steven A. Bratlie
*Attorney, Agent, or Firm*—Wenderoth, Lind & Ponack

[57] ABSTRACT

A writing instrument having a needle-like longitudinal writing nib, longitudinally slidably positioned in a nib holder pipe. The writing nib has flex portions and/or a flattened portion, for facilitating a longitudinal movement thereof when a writing pressure is added.

4 Claims, 12 Drawing Figures

RESILIENT WRITING NIB WITH OFFSET FLATTENED PORTION

BACKGROUND OF THE INVENTION

The present invention relates in general to a writing instrument of the kind comprising an ink reservoir and a nib holder pipe adapted to support a writing nib in the form of a needle or hair wire at one end of the reservoir and positioned to receive ink by capillary action from an ink carrier in the reservoir, and more particularly to an improved structure of the longitudinal writing nib axially slidably held in the nib holder pipe, with one end of the nib projecting from and resiliently retractable in the nib holder pipe.

A conventional writing instrument of the type described above is disclosed in U.S. Pat. No. 4,364,684, assigned to the present assignee, in which an ink permeable resilient seat member is inserted into a concave portion formed within a holder which holds slidably the writing nib. This structure is desirable in a sense that it provides a reliable axial movement due to the effect of the resilient seat member. On the other hand, the insertion of the resilient seat member as disclosed in the aforementioned U.S. Pat. No. 4,364,684 requires a higher degree of precision of the seat member, and provides some difficulties and increased labor.

An attempt has been made to provide a resilient writing nib so that the nib is axially and resiliently displaceable, as disclosed in unexamined Japanese Utility Model Application No. 54-85109, published Jan. 13, 1981 under Pub. No. 56-3684 and assigned to the present assignee. This structure does not necessitate, as separate members, the resilient seat member and a weight which forces movement of the nib by gravity, thus its entire structure can be simplified.

By the way, it is desirable that a movement force (or in other words a resilient force) of the writing nib be relatively small so as to minimize wearing of a tip of the writing nib. In order to lessen the movement force of the writing nib, an attempt has been made to minimize the diameter of the writing nib. However, it has been found that the writing nib of reduced-diameter induces much more wearing of the nib.

SUMMARY OF THE INVENTION

An object of the present invention is to provide an improved writing instrument which provides a desirable movement force of a writing nib.

Another object of the present invention is to provide a writing instrument which ensures a reliable movement of a writing nib for a long period of time.

An additional object of the present invention is to provide a writing instrument which permits a reliable and smooth flow of ink to the tip of the instrument.

A further object of the present invention is to provide a new writing nib for a writing instrument, the nib having a suitable movement force.

According to the present invention, the writing instrument has a cylindrical casing including therein an ink reservoir, a writing tip tube, a cylindrical holder for holding the tip tube, ink feed means between the cylindrical holder and the ink reservoir, and a longitudinal needle-like writing nib longitudinally slidably positioned in the tip tube, wherein the needle-like writing nib has at least two flex portions at its rear portion proximal to the ink feed means so that angles formed at each of the flex portions vary when the nib is displaced by a writing force.

In another embodiment of the invention, the writing instrument has a cylindrical casing including therein an ink reservoir, a writing tip tube, a cylindrical holder for holding the tip tube, ink feed means between the cylindrical holder and the ink reservoir, and a longitudinal needle-like writing nib longitudinally slidably positioned in the tip tube, wherein the needle-like writing nib has at least a single flattened portion at its rear portion proximal to the ink feed so that the flattened portion facilitates an axial movement of the writing nib. A flex portion or portions can be formed adjacent to the flattened portion. If necessary, a resilient seat of an ink permeable material may be disposed between the flattened portion and the ink feed means.

DETAILED DESCRIPTION OF PREFERRED EMBODIMENTS OF THE INVENTION

Figure 1:
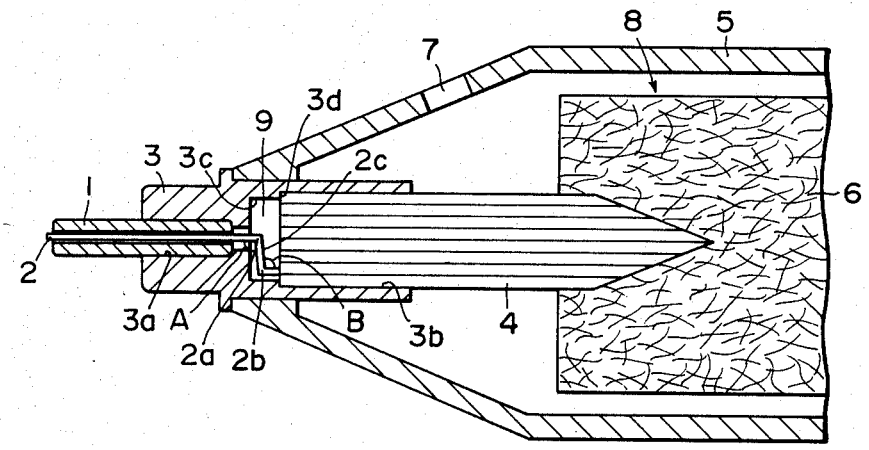
FIG. 1 is an enlarged sectional view of a part of a writing instrument, embodying the present invention.

Referring to the drawings, wherein like parts are designated by the same reference numerals throughout the various figures, a writing instrument includes an elongated hollow barrel or cylindrical casing generally indicated by the numeral 5, only a part of which is shown since the other part can be understood as being quite similar to the structure of the conventional writing instruments and since the other part is not related to the subject matter of the present invention. The casing 5 forms an ink reservoir 8, and an elongated ink carrier or filler 6 made of ink absorbent materials is housed in the reservoir 8. The ink carrier is preferably made of a material such as felt capable storing a large quantity of ink and is of generally circular cross section. Though not shown, the rear end of the casing is closed, for example, by a plug held in place by a press fit. The casing 5 has an air vent 7 at a fore end portion.

Referring first to FIG. 1 which shows a first embodiment of the invention, reference numeral 1 represents an elongated writing tip tube, or nib holder pipe fixed to a tubular holder 3, the tubular holder being connected to a tapered end, or force end, of the casing 5. The pipe 1 can be made of a suitable material such as a stainless steel or a suitable ceramics such as an α-alumina. Reference numeral 2 represents a needle-like writing nib, which is made of suitable resins such as polyacetal, polyolefin, polyamide or fluorine plastics, but may be made of a suitable metal such as a stainless steel. The elongated writing nib 2 may have ink feeding grooves or channels, not shown, as suggested by the aforementioned U.S. Pat. No. 4,364,684. The materials for the writing nib are not limited to the aforementioned examples if the materials provide a desirable resilience. The tubular holder 3 has a smaller bore 3*a* for the nib holder pipe 1 and a larger bore 3*b* for holding therein an ink feed core 4 and a middle bore 3*c* to form a space 9 between the smaller bore 3*a* and the fore end of the ink feed core 4, and to form a shoulder 3*d* to which a circumferential fore end portion of the ink feed core 4 is in close contact. The ink feed core is made of a bundle of synthetic fibers or any other self-adhesive synthetic monofilaments, and is tapered at its one end and connected to the filler 6 in the ink reservoir 8. Although the writing nib 1 is in close contact with the front end of the ink feed core 4 in the illustrated embodiment, it can be inserted deep into the front portion of the ink feed core 4. Furthermore, an ink tank (not shown) can be provided in the ink reservoir 8 instead of the ink feed core 4, and the writing nib 2 can be connected to the ink tank through a suitable ink feeding device or mechanism (not shown).

The writing nib 2, which is axially slidably mounted in the nib holder pipe 1 and slightly projecting from the fore end thereof when the writing instrument is not in use, in the embodiment of FIG. 1 extends rearwardly into the space 9 formed by the middle bore 3*c* and is bent at two portions to form flex portions 2*a*, 2*b* which have angles A and B, respectively, and a middle portion 2*c* between the flex portions 2*a*, 2*b*. The angles A and B are variable and changed when the writing nib is displaced or retracted within the nib holder pipe 1 when the writing instrument is in use. The bent or flex portions 2*a*, 2*b* can be formed at the same time when the writing nib 2 is formed, or otherwise after a linear nib material is formed by a suitable method.

Figure 2:
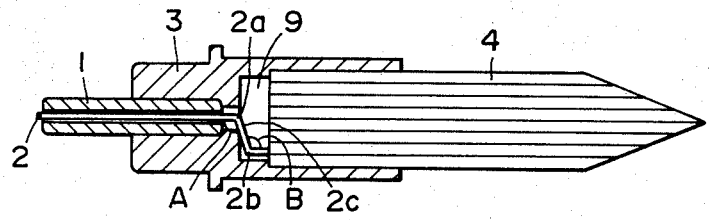
FIG. 2 is a sectional view of a part of a writing instrument according to another embodiment of the invention.
Figure 3:
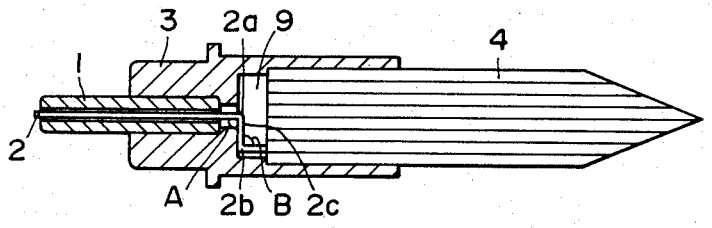
FIG. 3 is a sectional view of a part of a writing instrument according to a further embodiment of the invention.

Preferably, the writing nib 2 is designed such that the middle portion 2*c* between the flex portions 2*a*, 2*b* is contacted with the inner wall of the tubular holder 3 so as to provide a positional stability of the writing nib, as illustrated in FIGS. 2 and 3. More preferably, the middle portion 2*c* is resiliently and forcibly contacted against the inner wall of the tubular holder 3 as shown in FIG. 2 so that a moving force or resilience is given to the nib when the writing instrument is not in use. This structure can push the foreign particles out of the holder pipe 1. FIG. 3 shows that a substantial length of the middle portion 3*c* of the writing nib 3 is contacted with the inner wall of the tubular holder 3. In this structure, if a thrust is added to the nib portion between the inner wall of the tubular holder 3 and the front end of the ink feed core 4, lessening or lowering of the resilience of the nib 2 depends upon one of the flex portions, that is, the flex portion 2*a*.

Figure 4:
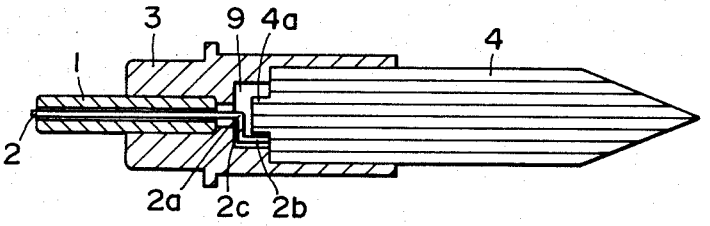
FIG. 4 is a sectional view of a part of a writing instrument according to another embodiment of the invention.

FIG. 4 shows another embodiment of the invention, in which a projection 4*a* is integrally formed on the front end of the ink feed core 4 so as to make the space 4 smaller. The smaller space 9 in the embodiment of FIG. 4 provides a more reliable retention of ink therein and prevents the ink in the space 9 from unwillingly returning to the ink feed core 4 and undesirably dropping from the pencil tip.

In the embodiments of FIGS. 1 through 4, the writing nib 2 is retracted towards the ink feed core 4 when a writing pressure is added to the nib 2. When the nib 2 is retracted by the writing pressure, the angles A and B of the flex portions 2*a*, 2*b*, respectively, of the nib 2 are changed, and a stress concentration on the flex portions 2*a*, 2*b* is produced from the initial stage of displacement of the writing nib 2. Thus, a smaller resilience or displacement force of the nib 2 enables a reliable displacement of the writing nib 2. Accordingly, wearing of the writing nib 2 can be minimized.

Figure 5:
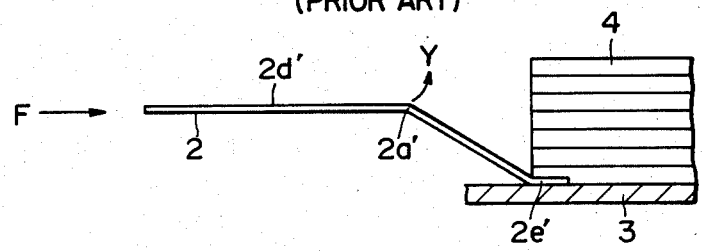
FIG. 5 (PRIOR ART)
FIG. 5 is an explanatory diagram showing the movement of a nib in a conventional writing instrument.

FIG. 5 is an explanatory diagram which shows an operation or movement of a nib of the conventional writing instrument as disclosed in the aforementioned Japanese unexamined publication No. 56-3684. In the conventional nib structure, when an axial thrust F (namely, a writing pressure) acts on the writing nib 2, the point designated at 2*a*′ which is the only and single movable or flex portion, moves back and outwardly as illustrated by an arrow Y, whereas the rear end portion 2*e*′ is fixed or not free to move. Thus, the axis of the substantial portion 2*d*′ moves radially outwardly from the original position, and undesirably contacts the inner wall of the nib holder pipe 1 (FIG. 1). This avoids a smooth movement of the writing nib and a smooth flow of ink along the writing nib.

Figure 6:
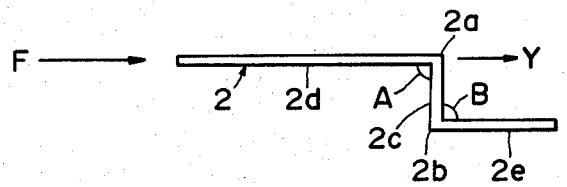
FIG. 6 is an explanatory diagram showing the movement of the nib for the instrument of FIG. 1.

FIG. 6 shows diagrammatically a desirable displacement of the nib 2 in accordance with the embodiments of the invention shown in FIGS. 1–4. As illustrated in FIG. 6, when a writing pressure F acts on the writing nib 2, the bendable or flex point 2*a* is retracted in a longitudinal directional as shown by arrow Y linearly along the same axis since there are two movable points 2*a*, 2*b* and the angles A,B of the flex portion 2*a*, 2*b* become smaller as the major portion 2*d* is retracted, and the rear end portion 2*e* is not fixed. Accordingly, the major portion 2*d* in the nib holder pipe 1 can be displaced linearly on the same axis without providing an undesirable frictional contact with the nib holder pipe 1. Thus, a smooth ink feed operation as well as a reliable displacement of the writing nib 2 can be established. Though not illustrated, more than two movable flex portions, such as the flex portions 2*a*, 2*b*, can be formed if desired. Also, the nib may have a wear-resistant layer on the end thereof.

Figure 7:
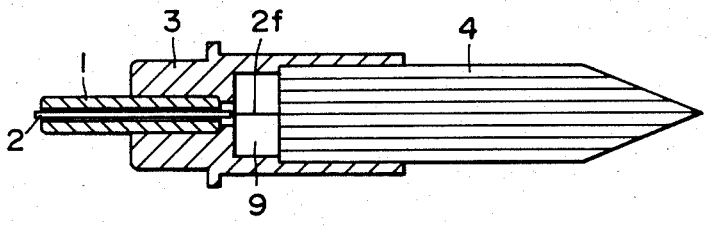
FIG. 7 is a sectional view of a part of a writing instrument according to another embodiment of the invention.
Figure 8:
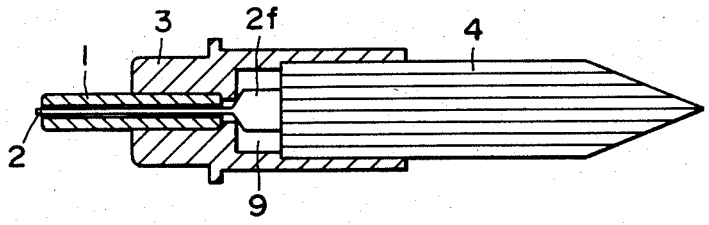
FIG. 8 is a sectional view of the part shown in FIG. 7, seen from the position at right angles to that of FIG. 7.

FIGS. 7 and 8 show a further embodiment of the invention. In this embodiment, the writing nib 2 has a planar or flattened linear portion 2*f* on the rear end portion. The flattened portion 2*f* can be formed by a heat-pressing or any other known methods. The flattened portion 2*f* is flexible and corresponds to the aforementioned flex portions 2*a*, 2*b* of the previous embodiments of FIGS. 1–4, and the flattened portion 2*f* is flexed or deflected when the writing nib is displaced by a writing pressure. Although the flattened portion 2*f* has a width larger than the diameter of the major portion of the nib 2 which prevents the nib from dropping out of the nib holder pipe 1, it can be formed such that the width of the flattened portion is substantially equal to the diameter of the nib 2.

Figure 9:
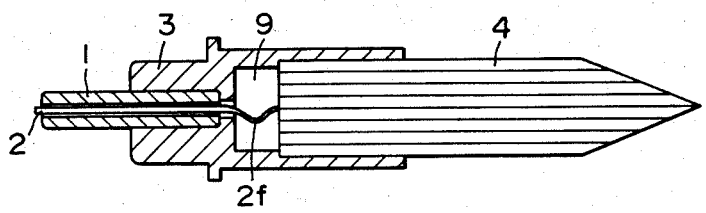
FIG. 9 is a sectional view of a part of a writing instrument according to another embodiment of the invention.
Figure 10:
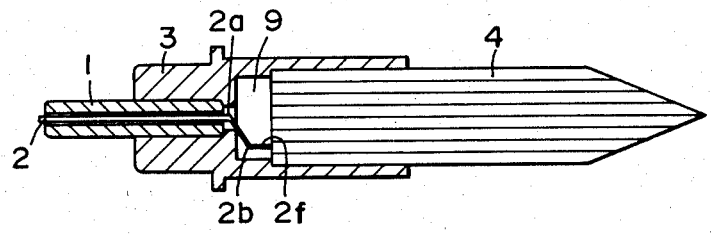
FIG. 10 is a sectional view of a part of a writing instrument according to a further embodiment of the invention.

FIGS. 9 and 10 show modifications of the embodiment of FIGS. 7 and 8. In FIG. 9, the flattened linear portion *2f* is bent at an angle to the longitudinal direction formed such that it is already flexed when the writing instrument is not in use. This provides a desirably small resilience at the initial stage of the nib displacement. For the same purpose, in the modification of FIG. 10 the rear portion located within the space 9 of the nib holder 3 is formed eccentric (offset) relative to the axis of the major portion of the writing nib 2. The writing nib 2 in FIG. 10 has not only the flattened portion *2f* which is flexible but also flex portions *2a, 2b* which correspond to the flex portions *2a, 2b* of the previous embodiments of FIGS. 1–4. The combination of the flattened portion and the flex portions *2a, 2b* produces a suitably weak displacement force, or resilience, of the writing nib 2. In order to desirably weaken the displacement force of the writing nib 2, it is generally suitable to increase the eccentricity of the rear portion which is positioned within the space 9 of the nib holder 3. However, care must be taken that the space 9, if formed excessively large, will cause a weaker ink retention force therein, resulting in defective ink-dropping from the writing tip and/or ink-returning to the ink feed core 4.

Figure 11:
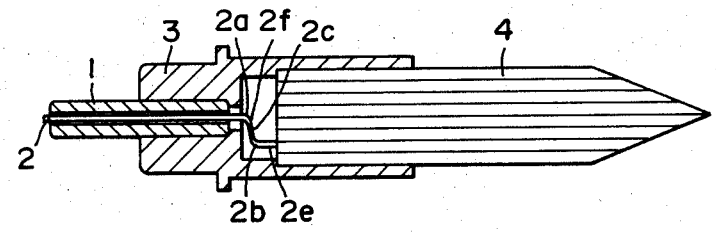
FIG. 11 is a sectional view of a part of a writing instrument according to another embodiment of the invention.
Figure 12:
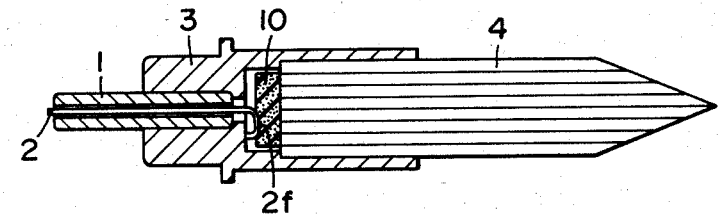
FIG. 12 is a sectional view of a part of a writing instrument according to an additional embodiment of the invention.

FIG. 11 shows a further modification, in which a flattened portion *2f* is formed on only the middle portion *2c* between the bent flex portions *2a* and *2b*, and the rear end portion *2e* is not flattened. FIG. 12 shows another structural modification, in which the nib 2 is L-shaped with a flattened portion *2f* and a resilient seat 10 of an ink permeable material is disposed between the flattened portion *2f* and the ink feed core 4. In this case, dimensional precision is not required for the resilient seat 10.

In all the embodiments of FIGS. 7–12, a flattened portion *2f* is formed at the rear end portion within the space 9 of the nib holder 3, and a desirably weak or small displacement force of the writing nib can be obtained. Thus, the wear of the writing nib end can be minimized.

Although the present invention has been described with reference to the preferred embodiments, many modifications and alterations can be made within the spirit of the invention.

What is claimed is:

1. A writing instrument comprising:

a cylindrical casing having an ink reservoir therein;

a tubular holder extending from one end of said casing;

ink feed means disposed between said tubular holder and said ink reservoir, said ink feed means having an ink feed core which consists essentially of a bundle of synthetic fibers;

a nib holder pipe positioned within said tubular holder and extending in a longitudinal direction; and a needle-like writing nib slidably positioned in said nib holder pipe, said writing nib having a rear end which is laterally offset to a front end thereof, said rear end being inserted in said ink feed core and not fixed with respect thereto, said writing nib having at least one flex portion thereon at a position between said nib holder pipe and said ink feed core and said writing nib having a flexible flattened linear portion thereon only at a position between said flex portion and said ink feed core, said flattened linear portion extending at an angle to said longitudinal direction, thereby providing a small resilience at the initial stage of nib displacement and preventing said writing nib from dropping out of said nib holder pipe.

2. The writing instrument according to claim 1, wherein said writing nib has two flex portions and one flattened portion between said flex portions.

3. A writing instrument comprising:

a cylindrical casing having an ink reservoir therein;

a tubular holder extending from one end of said casing;

ink feed means disposed between said tubular holder and said ink reservoir, said ink feed means having an ink feed core which consists essentially of a bundle of synthetic fibers;

a nib holder pipe positioned within said tubular holder and extending in a longitudinal direction;

a needle-like writing nib slidably positioned in said nib holder pipe, said writing nib having a rear end which is laterally offset to a front end thereof, said rear end being in fluid communication with said ink feed core, said writing nib having at least one flex portion thereon at a position between said nib holder pipe and said ink feed core and said writing nib having a flexible flattened linear portion thereon only at a position between said flex portion and said ink feed core, said flattened linear portion extending at an angle to said longitudinal direction, thereby providing a small resilience at the initial stage of nib displacement and preventing said writing nib from dropping out of said nib holder pipe; and a resilient seat member of an ink permeable material disposed between said rear end of said writing nib and said ink feed means.

4. The writing instrument according to claim 3, wherein said writing nib has two flex portions and one flattened portion between said flex portions.

* * * * *